US005787538A

United States Patent [19]

Moore et al.

[11] Patent Number: 5,787,538

[45] Date of Patent: Aug. 4, 1998

[54] CLEANING OF SUBMERGED SURFACES

[75] Inventors: Michael Edward Moore; Hendrikus Johannes Van der Meyden, both of Gauteng, South Africa

[73] Assignee: Baracuda International Corporation, Atlanta, Ga.

[21] Appl. No.: 675,469

[22] Filed: Jul. 3, 1996

[30] Foreign Application Priority Data

Jul. 7, 1995 [ZA] South Africa ..... 95/5665

[51] Int. Cl.[6] ..... E04H 4/16; B08B 5/04; B08B 9/00; F16L 11/00

[52] U.S. Cl. ..... 15/1.7; 134/21; 134/22.11; 138/118; 138/103; 138/120; 210/416.2; 210/169

[58] Field of Search ..... 134/21; 210/22.11, 210/416.2, 169; 138/118, 103, 120; 15/1.7

[56] References Cited

U.S. PATENT DOCUMENTS

| | | | |
|---|---|---|---|
| 3,108,298 | 10/1963 | Gelinas | 15/1.7 |
| 4,675,921 | 6/1987 | Jean-Jacques | 403/389 |
| 4,688,961 | 8/1987 | Shioda et al. | 4/490 |
| 5,082,028 | 1/1992 | Jean-Jacques | 138/118 |

FOREIGN PATENT DOCUMENTS

| | | |
|---|---|---|
| 0 239 498 | 9/1987 | European Pat. Off. . |
| 0 753 633 | 1/1997 | European Pat. Off. . |
| WO 95/11400 | 4/1995 | WIPO . |

*Primary Examiner*—Marian C. Knode
*Assistant Examiner*—Ali R. Salimi
*Attorney, Agent, or Firm*—Dean W. Russell; Kilpatrick Stockton LLP

[57] ABSTRACT

This invention provides an accessory for an automatic pool cleaner, to increase the randomness of movement of a suction head of the pool cleaner, and a method therefor. The method comprises looping a section of the cleaner hose and allowing the hose sections leading up to the loop to vary in length. Particularly, the hose section leading from the pump to the loop is varied. The accessory comprises two connection parts, one for connection to each respective section of hose to form the necessary hose loop. Preferably one of the parts is slidable along the hose length to enable the hose to vary its length. The sliding action of the hose occurs between two stops in the length of the hose, and a pawl mechanism is provided to enable the slide to occur in one direction towards a stop. Contact with the stop causes the pawl mechanism to switch over and slide the hose in the opposite direction.

8 Claims, 5 Drawing Sheets

CLEANING OF SUBMERGED SURFACES

FIELD OF THE INVENTION

This invention relates to a method of control of and an accessory for submerged surface cleaning devices.

BACKGROUND TO THE INVENTION

In particular, this accessory is suitable for use with submerged surface cleaning devices which operate with a suction head moving along the submerged surface. Water or liquid in which the device is submerged passes through the head along a hose to a pump position.

Most commonly such cleaners are known as automatic pool cleaners and are used for cleaning the submerged surfaces of swimming pools. The water sucked through the cleaning head and the hose passes into the pool filter by normal operation of the filter pump.

The suction head moves around on the submerged surface in an approximately random pattern, but the coverage achieved in this way is not always good. In many cases, the pool cleaner may settle down into a regular pattern of movement, such as a figure eight, or it may move to the pool corner furthest from the pump and either remaining stuck there, or move about in that area.

Applicant speculates that this is a result of what it terms "hose steerage". This is the tendency of the hose to steer the pool cleaner at least to some extent, as opposed to the motive force of the pool cleaner itself pulling the hose about the pool.

There is a tendency for the hose to want to straighten itself out, particularly in the length of hose that is immediately attached to the pool cleaner suction head itself.

The difficulty of obtaining good coverage in a pool can be severe, and in some cases can negate the usefulness of the automatic swimming pool cleaner device.

OBJECT OF THE INVENTION

It is an object of this invention to provide an accessory for a submerged surface cleaner, and a method of controlling a submerged surface cleaner, which can alleviate the above mentioned difficulty.

SUMMARY OF THE INVENTION

In accordance with this invention there is provided an accessory for a submerged surface cleaner, comprising connection means having two parts, each shaped to be securable to a respective one of two adjacent sections of a hose for the submerged surface cleaner, to form a loop in the hose between a suction position and the suction head in use, at least one part being slidable in use along the hose section to which it is securable.

There is further provided for there to be hose engaging means to be located on the slidable part of the connection means, and arranged to cause intermittent or step-wise sliding movement along that hose section. The engaging means may have cam surfaces co-operating with stops for reversing direction of the slidable part, by using movement of the engaging means on reaction against a stop.

There is also provided for the engaging means to be arranged to engage the spiral ridges in a conventional submerged surface hose.

Preferably the two parts are connected by an articulated joint. In one case the joint may comprise two transverse plane pivot joints which form a universal joint.

Alternatively, there is provided for the joint to be made of flexible material to provide universal movement.

Preferably if one part of the connection means is slidable, it is the part which is securable to a portion of the hose length furthest downstream from the other part and the suction head in use.

The invention extends to a stop mechanism for location in or around a hose, and arranged to stop the sliding movement of the slidable connecting means part in use.

According to one aspect of the invention there is provided for the slidable part to have at least one pair of arms with formations for engaging the hose at respective ends of the part, the arms being pivotable about a median position to allow only one arm formation to engage the hose in an engagement position at a time, and for the arms to have biasing means biasing the arms in an over-centre manner to engage the hose in an engagement position.

Further according to this aspect, there is provided for the slidable part to co-operate with stop mechanisms for reversing direction of the slidable part along the hose, the stops causing the arm in engagement with the hose to pivot to engage the opposing arm with the hose.

Still further according to the invention there is provided for the slidable part to comprise two pairs of arms in hinged connection about the hose, in use, to have corresponding arms for engaging the hose at a respective end.

Yet further according to the invention there is provided for the arms to have detents located on their respective ends for engaging the serrations on the hose.

Still further according to this aspect of the invention there is provided for the stop mechanism to be a tube having a radially tapered outer surface with circumferential, longitudinally spaced, inclined teeth sloping towards the radially thick end; and for the stop mechanism to be positioned, in use, such that the sliding part engages the radially narrow end and is rocked to the opposite stop position on reaching the radially thick end.

According to a second aspect of the invention there is provided for the stop mechanism to have inclined teeth closing towards an end stop surface; and for the end stop surface to be arranged to engage with the protruding end of a double ended pawl and slide one end of the pawl out of engagement with hose or stop projections, and simultaneously slide the other pawl end into engagement with such stop and or hose projections.

The invention extends to a method of controlling movement of a submerged surface cleaner, the cleaner operating in a liquid with a suction head moving over the surface to clean it, by the action of the liquid being sucked through the head along a hose connected to a pump, said method comprising looping a section of the hose between the pump and the suction head about a connection position to form a loop with one loop end passing from the connection position to the suction head and another loop end passing from the connection position to the pump, and allowing the connection position to move, to alter the length at least one of the loop ends.

Preferably both of the loop ends are allowed to change lengths with the connection position changing by sliding along the length of both hose sections passing through it. In the case of only one of the lengths being altered, it is preferred that the loop end connected to the pump has its length altered.

Further scope of applicability of the present invention will become apparent from the brief description of the drawings and the detailed description given hereinafter. However, it should be understood that the brief description of the drawings and the detailed description of the invention, while indicating preferred embodiments of the invention, are given by way of illustration only, since various changes and modifications within the spirit and scope of the invention will become apparent to those skilled in the art from these descriptions.

BRIEF DESCRIPTION OF THE DRAWINGS

Embodiments of the invention are described below by way of example only, and with reference to the accompanying drawings, in which.

DETAILED DESCRIPTION OF THE INVENTION

Figure 1:
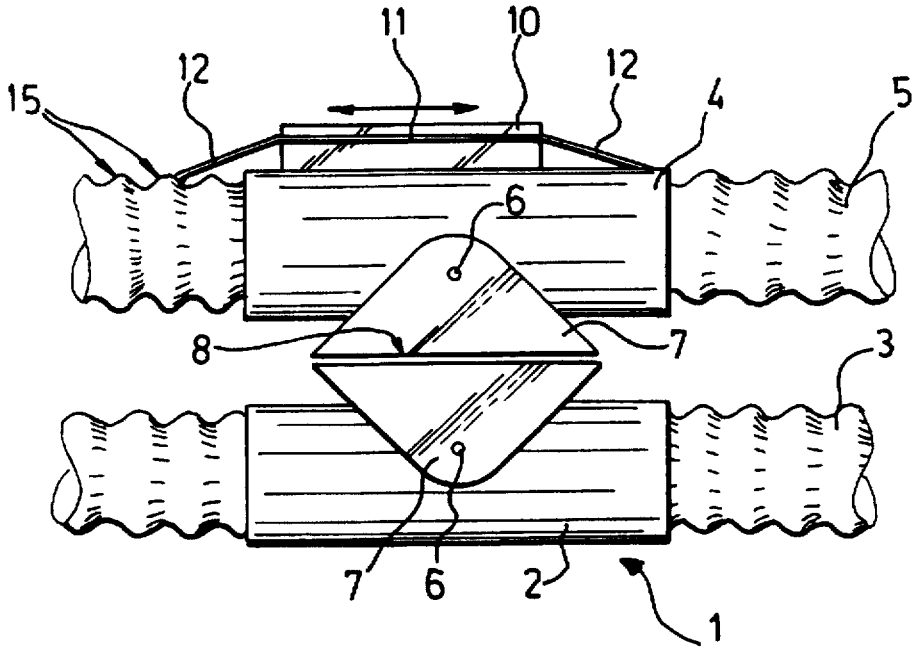
FIG. 1 is a side view of an accessory according to one embodiment of the invention.

Referring to FIG. 1, a swimming pool cleaner accessory (1) comprises a first part (2) of a length of tube slideable over a hose section (3), and a second part (4), which is a similar length of tube slidable over a hose section (5). The parts (4) and (2) are pivotally connected at diametrical positions (6) to brackets (7). The bracket bases are pivotally connected together about an axis (8) to swivel in a plane at right angles to the plane of swivel of the pivot (6), to allow substantially universal movement between the tube sections.

The part (4) has a slidable pawl mechanism (10), having a middle section (11) slidable on the periphery of the tube (4) in the axis thereof, with each end having a downwardly inclined engaging section (12) which is able to engage, depending on its position of slide, with spiral serrations (15) of the hose length (5) passing through the tube.

Figure 2:
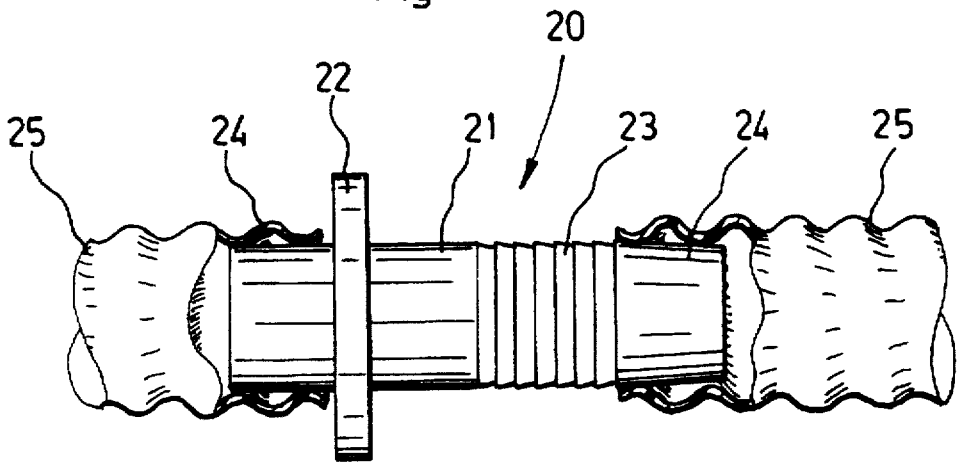
FIG. 2 is a side view of a hose stop for the accessory of FIG. 1.

Referring to FIG. 2, a stop mechanism (20) is shown, for location in use in pairs in a hose section to confine sliding movement of the accessory of FIG. 1, to a length of hose between two stops.

The stop (20) comprises a tubular body (21) having a radially extending stopping flange (22) towards one end, and annular inclined teeth (23) around the other end. The teeth are inclined towards the stop. At each end extending from the flange (22), and the end of the teeth (23), is a joining section (24) for clamping a hose end (25) to join the stop in the length of the hose.

When located over a hose, the pawl end (12) engages successive spiral ridges on the hose to cause the tube part (4) to move in one direction of slide. As the part nears the stop, the pawl will engage the ridges (23) to positively force the tube against the stop (22) and slide the pawl, thus changing direction of slide of the tube.

Figure 3:
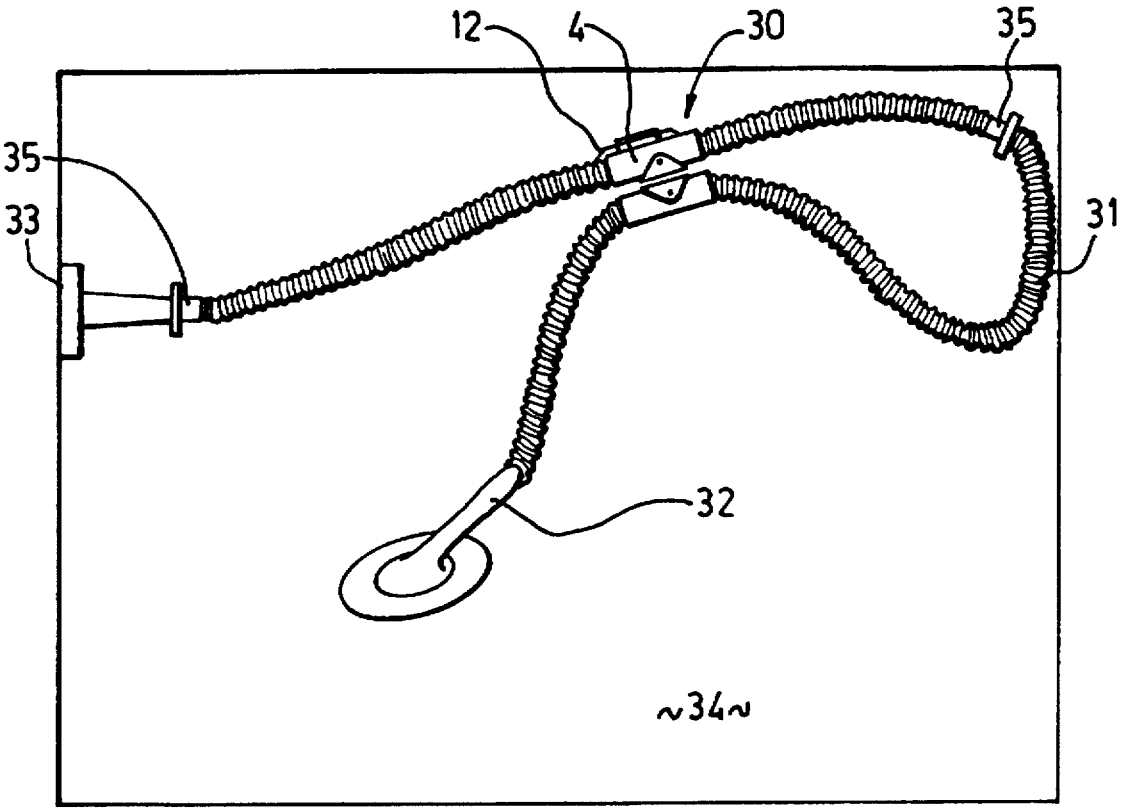
FIG. 3 is a diagrammatic plan view of the accessory and stops of FIGS. 1 and 2 in operation in use in a swimming pool.

In use, the accessory (30) is shown in FIG. 3 connected to a pool cleaner hose (31). The hose is attached to a pool cleaner suction head (32), to conduct water therethrough to a pumping position (33) in a pool (34). The hose (31) is threaded through each of the two tube parts, so that they may slide over the hose. The part (4) has the pawl ends (12) engaging with the ridges on the hose. The hose section passing through part (4) has stops (35), as described with reference to FIG. 2, located therein, with the serrations facing each other over the hose length between them.

As the pool cleaner is operated, the vibratory movement through the hose causes the tube parts (4) and (2) to slide along the length of the hose, with the part (4) being guided in one direction only at a time, until the part has reacted against one of the stops (35), to be directed oppositely. It has been found in practice that this alteration of the effective length of the hose, particularly between the pump position and the loop connection position, causes an increased randomness in the nature of the movement of the pool cleaner suction head (32).

Whilst the part (2) will also slide, it is believed that the alteration of the length of the hose between the pool cleaner head (32) and the loop connection position, does not contribute greatly to the increase in random movement, since the first metre or so of the hose immediately after the suction cleaner directs most of its energy towards imparting movement to the suction head itself.

Figure 4:
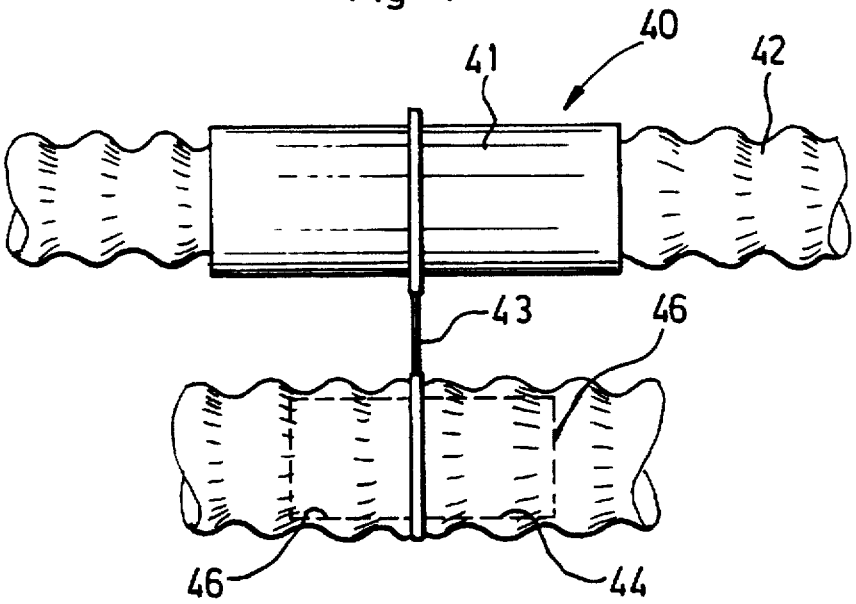
FIGS. 4 & 5 are views of parts of a second embodiment of an accessory according to the invention.
Figure 5:
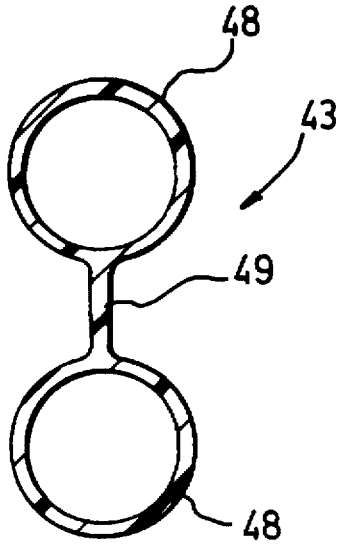

Referring now to FIGS. 4 and 5, an alternative embodiment of an accessory is shown. This accessory (40) is shown having a tubular section (41) which is slidable over a length of hose (42), and is connected by a connecting strap (43) to a tube (44). The tube (44) carries the strap around its middle section, and extending to each side of its middle section is a hose connection (46) for receiving the ends of a hose. The connecting strap (43) (FIG. 5) is made up of a flexible plastics material, and has two rings (48) connected by a strap (49). Connection of the tube parts (44) and (41) is achieved by locating the ring around the middle of these parts.

The effect is that the accessory is secured in a non-slidable manner to the one hose section at the position (44), but in a slidable manner through the tube (41) to the other section. Movement between the two sections is of a universal nature through the flexible strap (49). The movement of the pool cleaner serves to shorten or lengthen the hose sections passing through the slidable tube part (41), and serves to increase the random movement of the pool cleaner in use.

Figure 6:
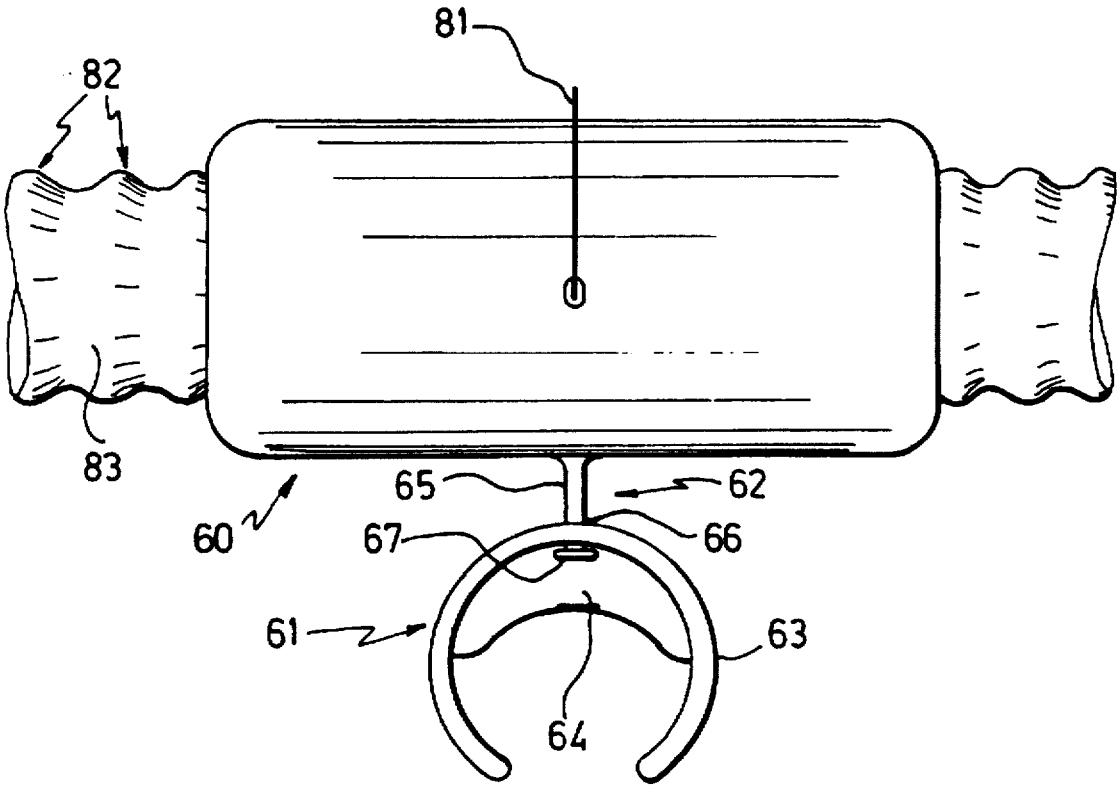
FIG. 6 is a plan view of an accessory according to a third embodiment of the invention.
Figure 7:
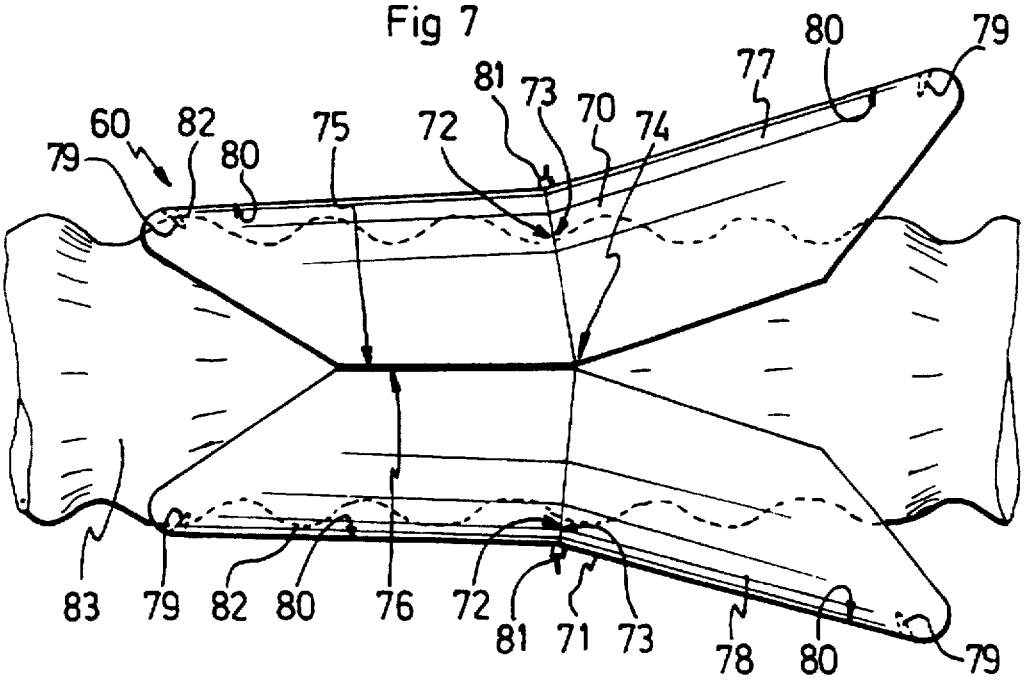
FIG. 7 is a sectional elevation of the embodiment in FIG. 6.

A third embodiment of an accessory is shown in FIGS. 6 and 7. The accessory has a slidable part (60) and non-slidable part (61) connected by a universal joint (62). The non-slidable part has the shape of a tube with a longitudinal strip removed to form a c-shaped clamp (63) in end view. The clamp (63) has a radially inwardly extending flange (64) extending through an arc and positioned centrally in the length of the clamp, on its inner surface. The clamp provides a resilient fit over the hose (not shown) and the flange engages in a section of the groove between spiral ridges on the hose to prevent axial movement along the hose.

The universal joint (62) comprises a spigot (65) extending from the slidable part, and which is movable within an aperture (66) in the non-slidable part. The spigot is retained in the aperture by a head (67), preferably formed by a screw and washer. This arrangement allows both axial and rotational movement of the spigot in the aperture.

The slideable part (60) comprises two shells (70, 71) which are hinged together (FIG. 7). Each shell approximates two longitudinally split tubes joined at one pair of abutting ends (72, 73) to form a shallow v-shape with the apex (74) of the "v" formed at the centre of each longitudinal edge of the combined split tubes. The included angle of the "v" shape is obtuse. The shells are located with respective longitudinal edges facing each other and the apices abutting. The apices are hinged to allow the shells to pivot between two stop positions. In one stop position the opposing longitudinal edges (75, 76) of the shells on one side of the pivot abut and the opposing ends (77, 78) on the other side of the pivot diverge away from each other. In the other stop position longitudinal edges of opposing ends (77, 78) abut and the opposing ends on the other side of the pivot diverge away from each other.

Detents (79) are located on the operatively inner surface (80) of the respective ends of each shell. The detents are in the form of inwardly projecting teeth. A c-shaped spring (81) acts at the centre of each shell in the hollow formed by the "v", to urge the shells together. The spring provides an over-centre bias which encourages the shells to assume either of the two stop positions.

In use, the detents on opposing shell ends which are in a stop position, engage the serrations (82) in the hose (83) causing axial step-wise motion of the slidable part along the hose in the direction of the abutting ends.

Figure 8:
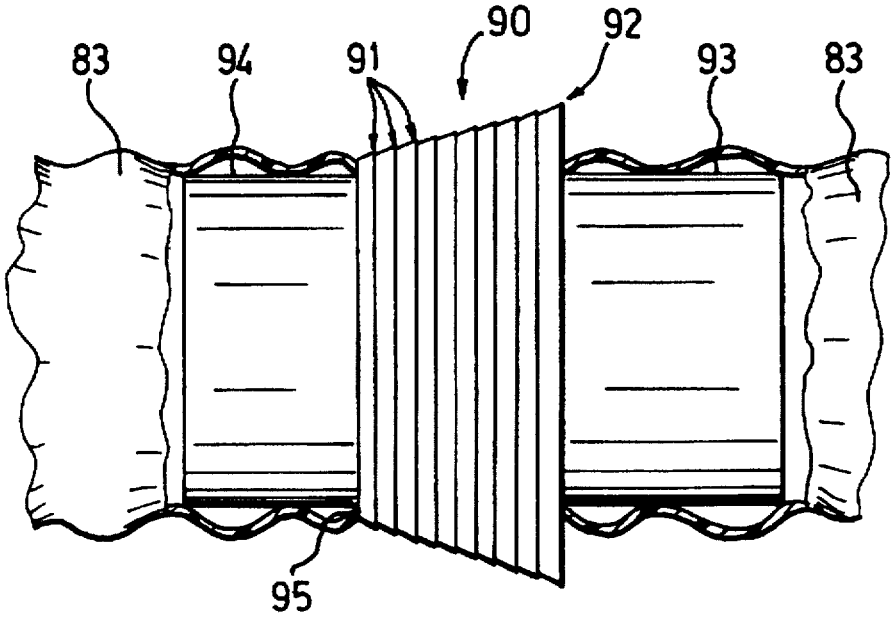
FIG. 8 is a plan view of a stop for the embodiment in FIG. 6.

A stop mechanism according to this embodiment is shown in FIG. 8 and is a tube (90) having a radially tapered outer surface with circumferential, longitudinally spaced, inclined teeth (91) sloping towards the radially thick end (92). Joining sections (93, 94) form each tube end, for securing hose ends (83) and locate the stop in the length of the hose.

A stop mechanism is positioned, in use, with the radially narrow end (95) towards the sliding part. The detents on the sliding part, in engagement with the serrations in the hose, will engage the inclined teeth in the stop mechanism and the corresponding shells will be forced apart as the shell ends slidable part move up the taper of the stop. On reaching the radially thick end, the shells are pivoted by the over centre biasing to the opposite rest stop position and the slidable part commences travel in the opposite direction.

It is considered that the invention provides a simple and effective method and apparatus for use with a swimming pool cleaner, or any submerged surface cleaner operating on the same general principle.

The present invention having been described above, modifications and variations of the present invention will be apparent to those skilled in the art from the foregoing description of the invention. Such modifications and variations are not to be regarded as a departure from the spirit and scope of the invention and are intended to come within the scope of the appended claims.

What is claimed is:

1. An apparatus for connecting to a hose having first and second sections, the second section having a length, comprising:

a. a first part adapted to be attached to the first section of the hose;

b. a second part adapted to be positioned along the second section of the hose;

c. means for connecting the first and second parts; and d. means for causing the second part to move along the length of the second section of the hose.

2. The apparatus according to claim 1 further comprising means for reversing the direction of the movement of the second part along the length of the second section of the hose.

3. The apparatus according to claim 1 wherein the connecting means comprises means for permitting the second part to move in multiple planes relative to the first part.

4. The apparatus according to claim 1 wherein the first and second parts are substantially tubular.

5. The apparatus according to claim 1 wherein the movement causing means comprises a pawl.

6. The system for cleaning a swimming pool comprising:

a. a pump;

b. an automatic swimming pool cleaner;

c. a hose connecting the pump to the automatic swimming pool cleaner, the hose having first and second sections, the second section having a length; and d. an accessory connected to the hose, comprising:

i. a first part connected to the first section;

ii. a second part positioned along the second section;

iii. means for connecting the first and second parts; and iv. means for causing the second part to move along the length of the second section.

7. A method of controlling motion of an automatic swimming pool cleaner connected to a pump via a hose having first and second sections, the second section having a length, comprising:

a. providing an accessory having connected first and second parts;

b. attaching the first part to the first section of the hose;

c. positioning the second part along the second section of the hose; and d. moving the second part along the length of the second section of the hose.

8. The method according to claim 7 further comprising reversing the direction of movement of the second part along the length of the second section of the hose.

* * * * *